United States Patent [19]

Carolus et al.

[11] 4,209,792

[45] Jun. 24, 1980

[54] ANTENNA CABLE DRIVE AND STORAGE DRUM WITH STOP MECHANISM

[75] Inventors: David T. Carolus; Ralph W. Edwards, both of Dayton; Paul C. Morrin, Kettering, all of Ohio

[73] Assignee: General Motors Corporation, Detroit, Mich.

[21] Appl. No.: 962,923

[22] Filed: Nov. 22, 1978

[51] Int. Cl.[2] ..... H01Q 1/10

[52] U.S. Cl. ..... 343/903

[58] Field of Search ..... 343/909, 877, 900, 901

[56] References Cited

U.S. PATENT DOCUMENTS 3,893,125 7/1975 De Bellomayre ..... 343/903

*Primary Examiner*—Eli Lieberman

*Attorney, Agent, or Firm*—Donald F. Scherer

[57] ABSTRACT

An antenna cable drive and storage drum has a member threaded on the housing and rotatable with the drum. The member is effective to release a pair of stop plungers which engage between the drum and housing to create a substantial resistance to further rotation of the drum if the drum is rotated in either direction more than the predetermined number of revolutions which are needed to either fully extend or fully retract the cable.

3 Claims, 3 Drawing Figures

ANTENNA CABLE DRIVE AND STORAGE DRUM WITH STOP MECHANISM

This invention relates to antenna cable drive and storage drum mechanisms and more particularly to antenna cable drives wherein a rotary resistance is applied to the storage drum after a predetermined number of revolutions has occurred.

It is an object of this invention to provide an improved antenna cable drive and storage mechanism having a stop control device to prevent excessive rotation of the storage drum.

It is another object of this invention to provide an improved antenna cable drive and storage drum having a mechanism for applying a rotational resistance to the storage drum if the drum is rotated more than a predetermined number of revolutions.

A further object of this invention is to provide an improved antenna cable drive and storage drum wherein a threaded member is rotated with the storage drum and translates along a portion of the housing while the antenna cable is extended and retracted and wherein the threaded member is effective to release a plunger mechanism which engages between the drum and housing if the drum continues to rotate more than a predetermined number of revolutions to either extend or retract the cable.

These and other objects and advantages of the present invention will be more apparent from the following description and drawings in which.

Figure 1:
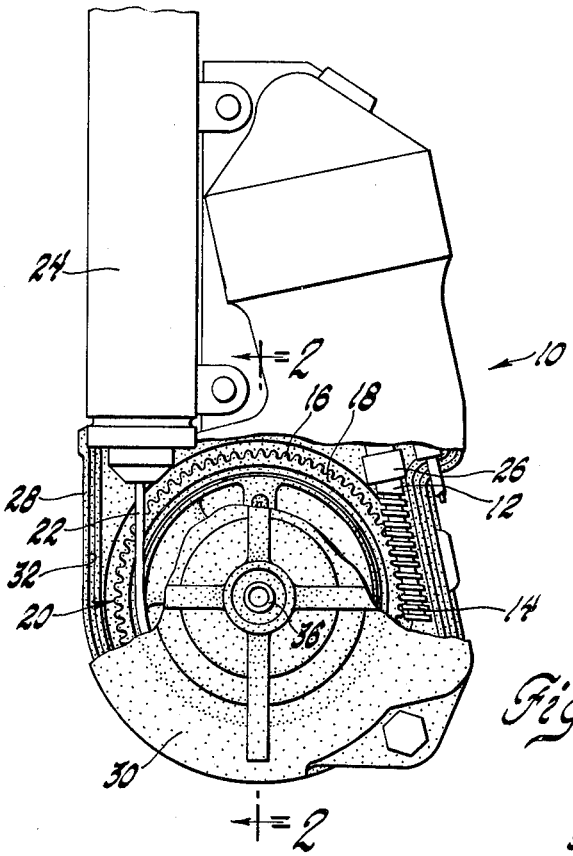
FIG. 1 is a side elevational view of an antenna drive and storage mechanism.

Referring to the drawings, wherein like characters represent the same or corresponding parts throughout the several views, there is seen in FIG. 1, a portion of a power driven antenna having an electric drive motor disposed within a housing generally designated 10 and having an output shaft 12 on which is formed a drive worm 14. The drive worm 14 engages a worm gear 16 formed on the outer periphery of an input member 18 of a drive and cable storage drum generally designated 20. A cable 22 extends from the drum 20 and is connected to a conventional telescoping antenna, not shown, which is housed in a mast jacket 24 adapted to be secured to a vehicle body, not shown. A motor control reaction switch 26 is disposed between the drive motor and the worm 14 and is preferably constructed in accordance with the switch shown in U.S. Ser. No. 900,051, filed Apr. 26, 1978, and assigned to the assignee of the present invention.

The reaction switch 26 is operable to discontinue operation of the electric motor when the antenna reaches either full extension, full retraction or encounters an obstacle which prevents movement as long as the cable 22 is connected to the antenna mast. Prior to the actuation of the reaction switch 26, the forces necessary to cause actuation must be transmitted through the cable 22 to the worm gear 16. The drive drum 20 transmits these forces and also absorbs inertia forces which are present within the system. To accomplish the inertia absorption, the drum 20 is preferably constructed in accordance with U.S. Ser. No. 938,752, filed Sept. 1, 1978, and assigned to the assignee of the present invention.

The electric motor and drum 20 are preferably contained in a two-piece housing including a body portion 28 and a cover 30. In FIG. 1, a portion of cover 30 over the drive drum 20 and worm 14 has been removed. The body portion 28 has a groove 32 about the periphery thereon in which is disposed a seal 34 for sealing of the cover and body. The body 28 and cover 30 are secured together by a plurality of spring clips, not shown, and a rivet 36.

The drum 20 includes the input member 18 and an output member 40. The input member 18 has a frustoconical section 42 which cooperates with a frustoconical section 44 formed on output member 40 to form the cable storage area between the input member 18 and output member 40. The output member 40 has a cylindrical portion 46 which is rotatably supported on a cylindrical portion 48 formed on the body 28. Also mounted on the cylindrical portion 48 is an externally threaded member 50 on which is threadably engaged an internally threaded member 52 having a pair of radially extending arms 54 and 56 which are disposed in cylindrical slots 58 and 60, respectively, formed in the output member 40. The lower end of member 50 has a groove 62 formed therein, in which groove 62, an annular support tab 64 is located which is integral with the input member 18 and provides a rotational support for the input member 18. A shoulder 66 is formed on the member 50 adjacent the right end of the threaded surface thereof as viewed in FIG. 2. A cap member 68 is supported on the cylindrical portion 48 at the left end of the member 50. The cap member 68 is secured to the body 28.

Figure 2:
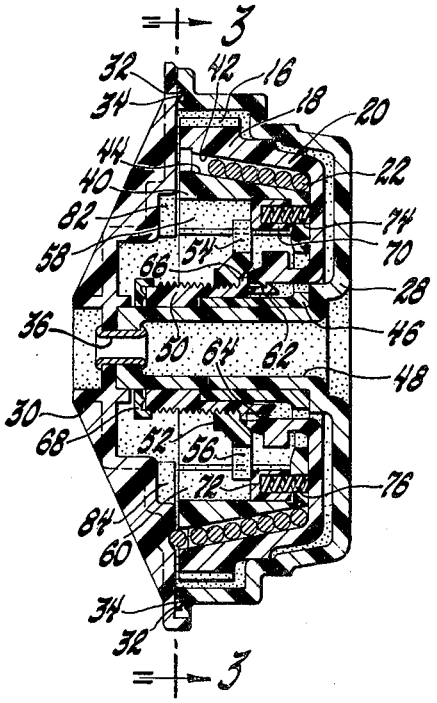
FIG. 2 is a sectional view taken along line 2—2 of FIG. 1.
Figure 3:
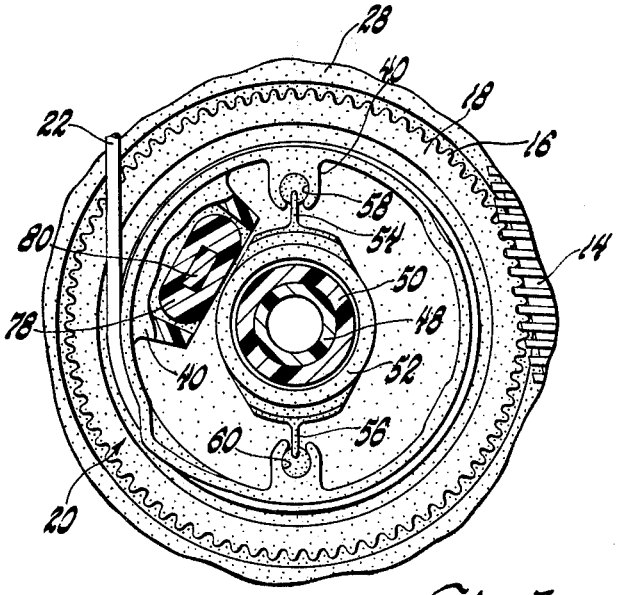
FIG. 3 is a sectional view taken along line 3—3 of FIG. 2.

A pair of plungers or pins 70 and 72 are slidably disposed in the cylindrical slots 58 and 60, respectively, and the plungers 70 and 72 are urged from right to left, as viewed in FIG. 2, by compression springs 74 and 76, respectively. The plungers 70 and 72 are prevented from moving freely in the slots 58 and 60 by the radial arms 54 and 56.

The antenna cable 22, as shown in FIG. 2, is in the fully retracted position. If the cable drive mechanism is actuated to extend the cable 22, the input member 18 will be rotated by the worm 14 and worm gear 16, and the output member 40 will be driven through the resilient member 78 which is located on a drive tang 80 formed in the input member 18. This resilient drive mechanism is constructed in accordance with the drive mechanism shown in the above U.S. Ser. No. 938,752. As the cable 22 is extended, the member 52 will be rotated relative to the member 50 and will translate along the member 50 due to the threaded connection therebetween. When the antenna mast is fully extended, a resistance to further rotation to the drum 20 occurs because the cable resists further movement such that the reaction switch 26 will discontinue operation of the electric motor in accordance with the above mentioned U.S. Ser. No. 900,051.

When the cable is retracted, the reaction switch 26 will also discontinue operation of the electric motor as long as the cable 22 remains attached to the antenna mast. On retraction of the cable 22, the member 52 will again translate along member 50 to stop in the position shown in FIG. 2. As the member 52 translates along the member 50, the plungers 70 and 72 will also move linearly within the respective cylindrical slots 58 and 60.

If the cable 22 should become detached from the antenna mast, there will not be sufficient load on the worm gear 14 to actuate the reaction switch 26 such that the electric motor will continue to operate. If the cable 22 is being moved to the extended position when cable separation occurs, the member 52 will continue to translate along member 50 until the cap member 68 is abutted by the member 52. When abutment between these members occurs, further rotation of the member 52 is not permitted. However, the output member 40 continues to rotate which will result in the radial arms 54 and 56 being withdrawn from the cylindrical slots 58 and 60, respectively, thereby freeing the plungers 70 and 72. When the plungers 70 and 72 are free, they will be urged by the spring members 74 and 76 to engage in circular slots 82 and 84 formed in the cover 30. With the plungers 70 and 72 thus engaged, the drum 20 will be mechanically connected to the cover 30 such that further rotation is prohibited. This will result in a high reaction force being applied to the worm gear 14 thereby actuating the reaction switch 26 which will discontinue operation of the electric motor. If cable separation should occur during retraction of the cable 22, the member 52 will translate along member 50 until the shoulder 66 is encountered thereby preventing further rotation of the member 52 such that the radial arms 54 and 56 will be withdrawn from the cylindrical slots 58 and 60, thereby freeing the plungers 70 and 72 so that the drum 20 will be mechanically connected to the cover 30 resulting in a high reaction load as described above. Once the plungers 70 and 72 have been released, the electric motor cannot be reenergized until the cable 22 has been repaired.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. An antenna cable drive and storage mechanism comprising; a stationary housing; a reversible rotatable drive and storage drum mounted on said housing; means for rotating said drum; a cable drivingly connected to said drum and being stored thereon and being extended from and retracted into said housing by rotation of said drum in one direction or the other during a predetermined number of revolutions of said drum in each respective direction; and drum rotation responsive means drivingly connected to said drum and selectively operatively connectable with said housing for imposing a rotational resistance to said drum if said drum is rotated more than the predetermined number in either direction.

2. An antenna cable drive and storage mechanism comprising; a stationary housing; a reversible rotatable drive and storage drum mounted on said housing; means for rotating said drum; a cable drivingly connected to said drum and being stored thereon and being extended from and retracted into said housing by rotation of said drum in one direction or the other during a predetermined number of revolutions of said drum in each respective direction; and drum rotation responsive means including a threaded means drivingly connected to said drum and threadably connected with said housing for translation on said housing a predetermined amount in response to rotation of said drum and spring loaded plunger means slidably disposed in said drum in response to translation of said threaded means and being released by said threaded means if the translation exceeds the predetermined amount to engage said drum with said housing for imposing a rotational resistance to said drum.

3. An antenna cable drive and storage mechanism comprising; a stationary housing; a reversible rotatable drive and storage drum mounted on said housing; means for rotating said drum; a cable drivingly connected to said drum and being stored thereon and being extended from and retracted into said housing by rotation of said drum in one direction or the other during a predetermined number of revolutions of said drum in each respective direction; and drum rotation responsive means including a thread formed on said housing, translating means threaded on said thread and having drive tangs drivingly connected to said drum, slot means in said housing and plunger means slidably disposed in said drum and maintained out of engagement with said slot means by said drive tangs, said translating means being rotated by said drum for translation on said thread during the predetermined number of revolutions and being engaged by said housing if the revolutions exceed the predetermined number thereby preventing further rotation of said translating means whereby said drive tangs are disconnected from said drum and said plunger means will engage said slot means imposing a rotational resistance to said drum if said drum is rotated more than the predetermined number in either direction.

* * * * *